US006661179B2

(12) United States Patent
Aoki et al.

(10) Patent No.: US 6,661,179 B2
(45) Date of Patent: Dec. 9, 2003

(54) METHOD AND APPARATUS FOR ADJUSTING CHARACTERISTICS OF MULTI ELECTRON SOURCE

(75) Inventors: Shuji Aoki, Kanagawa (JP); Takahiro Oguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/227,346

(22) Filed: Aug. 26, 2002

(65) Prior Publication Data

US 2003/0057850 A1 Mar. 27, 2003

(30) Foreign Application Priority Data

Aug. 27, 2001 (JP) ..... 2001-255932

(51) Int. Cl.[7] ..... G09G 3/10

(52) U.S. Cl. ..... 315/169.1; 345/206; 445/3; 445/63

(58) Field of Search ..... 315/169.1, 169.3; 345/204, 206, 208, 210, 698; 445/3, 63

(56) References Cited

U.S. PATENT DOCUMENTS

| | | | | |
|---|---|---|---|---|
| 5,455,597 A | | 10/1995 | Nakamura et al. | 345/75 |
| 5,659,329 A | | 8/1997 | Yamanobe et al. | 345/74 |
| 6,144,350 A | * | 11/2000 | Fujii et al. | 345/74.1 |
| 6,184,851 B1 | * | 2/2001 | Yamaguchi et al. | 345/75.2 |
| 6,225,749 B1 | * | 5/2001 | Kobayashi et al. | 315/169.3 |
| 6,231,412 B1 | * | 5/2001 | Kawade et al. | 445/3 |
| 6,445,367 B1 | | 9/2002 | Suzuki et al. | 345/75.2 |
| 6,490,433 B1 | * | 12/2002 | Kawade | 445/6 |

FOREIGN PATENT DOCUMENTS

| | | | | |
|---|---|---|---|---|
| EP | 0785564 | * | 7/1997 | |
| EP | 0803892 | * | 10/1997 | |
| EP | 0 803 892 A2 | | 10/1997 | H01J/29/08 |
| JP | 06-342636 | * | 12/1994 | |
| JP | 6-342636 | | 12/1994 | H01J/31/12 |
| JP | 10-228867 | | 8/1998 | H01J/9/44 |
| JP | 2000-228867 | * | 8/1998 | |
| JP | 2000-066633 | * | 3/2000 | |
| JP | 2000-243256 | * | 9/2000 | |
| JP | 2000-310973 | * | 11/2000 | |

OTHER PUBLICATIONS

U.S. patent application Ser. No. 09/328,804, filed Jun. 9, 1999.

U.S. patent application Ser. No. 10/067,796, filed Feb. 8, 2002.

U.S. patent application Ser. No. 10/209,876, filed Aug. 2, 2002.

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

A method for adjusting electron emitting characteristics of a multi-electron source having plural electron emitting devices disposed on a substrate. The method comprises measuring electron emission characteristics of the devices and setting a characteristic adjustment target value. Plural characteristic shift voltages having discrete values are applied to some of the devices, electron emission characteristics of each of these devices are measured, and a characteristic adjustment table is generated for each characteristics shift voltage value according to change rates of these measured characteristics. A predetermined characteristics shift voltage value is selected based on the corresponding table, and that voltage is applied to the devices to cause their characteristics to shift towards the target value. A change in the electron emission characteristics is monitored to revise the characteristics shift condition.

6 Claims, 9 Drawing Sheets

METHOD AND APPARATUS FOR ADJUSTING CHARACTERISTICS OF MULTI ELECTRON SOURCE

BACKGROUND OF THE INVENTION

1. Field of the Invention

The present invention relates to a method and apparatus for adjusting the characteristics of a multi electron source having a number of surface conduction electron-emitting devices.

2. Related Background Art

Two types of electron emitting-devices are known, hot cathode devices and cold cathode devices. Known cold cathode devices include field emission devices (hereinafter described as FE), metal/insulator/metal emission devices (hereinafter described as MIME) and surface conduction electron-emitting devices (hereinafter described as SCE).

The present applicants have studied a multi electron source having a number of passive-matrix wired SCEs and an image display apparatus using such a multi electron source, as disclosed in Japanese Patent Application Laid-open No. 06-342636.

SCEs constituting a multi electron source have some dispersions in the electron emission characteristics because of process variations. If a display apparatus is manufactured by using such SCEs, dispersions in the characteristics result in dispersions in luminance. Japanese Patent Application Laid-open No. 10-228867 discloses the invention that dispersions in the SCE electron emission characteristics are removed by utilizing a memory capability of the SCE electron emission characteristics.

The present invention also relates to a technique of leveling the characteristics of a multi electron source by utilizing the memory capability of the SCE electron emission characteristics, similar to the above-described prior art (Japanese Patent Application Laid-open No. 10-228867), and provides an improved technique suitable for mass production of electron source panels.

According to the prior art technique, a characteristics leveling process incorporated in an electron source manufacture process is likely to have dispersions in adjustment times taken to adjust electron-emitting devices. There is therefore the possibility of dispersions in the adjustment times taken to adjust the characteristics of electron source panels and variations in adjusted electron emission characteristics.

The invention provides a manufacture process capable of manufacturing electron source panels having generally the same electron emission characteristics in generally the same process time even if the memory performance of the electron emission characteristics of SCEs constituting a multi-electron source is different among electron-emitting devices or among electron source panels.

An object of the invention is therefore to provide a method and apparatus for adjusting the characteristics of multi electron sources with simple processes, the multi electron sources having generally the same electron emission characteristics and adjusted in generally the same adjustment time.

SUMMARY OF THE INVENTION

According to the invention, prior to adjusting the characteristics, initial electron emission currents of all devices are measured to set a characteristics adjustment target value. By using some devices, the emission current change characteristics are measured at characteristics shift voltages. In accordance with an average of the measured characteristics, a characteristics adjustment table is created. Next, by referring to the characteristics adjustment table, the pulse peak and width of the characteristics shift voltage and the number of pulses to be applied to each device are determined to perform characteristics shift driving for removing a characteristics shift amount which is a difference between an initial electron emitting current and a characteristics adjustment target value. A change in electron emission characteristics during the characteristics shift driving is monitored to set again, when necessary, the characteristics shift conditions including the pulse peak and width and the number of pulses of the characteristics shift voltage.

DETAILED DESCRIPTION OF THE PREFERRED EMBODIMENTS

The invention will be described with reference to the embodiments.

The present applicants have found that prior to ordinary driving, preliminary driving disclosed in Japanese Patent Application Laid-open Nos. 2000-310973 and Japanese Patent Application Laid-open No. 2000-243256 is performed during a manufacture process in order to improve the characteristics of SCEs and reduce a luminance change with time. In this embodiment, the preliminary driving and an electron source characteristics adjustment are integrally performed.

The preliminary driving is a process of driving SCEs subjected to a stabilization operation at a voltage Vpre for a predetermined period and measuring an electric field intensity near an electron-emitting region during this drive. Thereafter, normal image display driving is performed at a normal drive voltage Vdrv generating a smaller electric field intensity. As the device electron-emitting region is driven by a large electric field intensity at the voltage Vpre, the structural member which causes instability of a change in the characteristics with time is changed concentrically in a short time. It is considered that this method can reduce the change factors of display luminance of the display device driven at the normal drive voltage Vdrv.

The method of adjusting the electron emission characteristics of SCEs subjected to the preliminary driving by using the memory performance of the SCE electron emission characteristics will be briefly described. The details thereof are described in the above-cited Japanese Patent Application Laid-open No. 2000-243256.

Figure 1A:
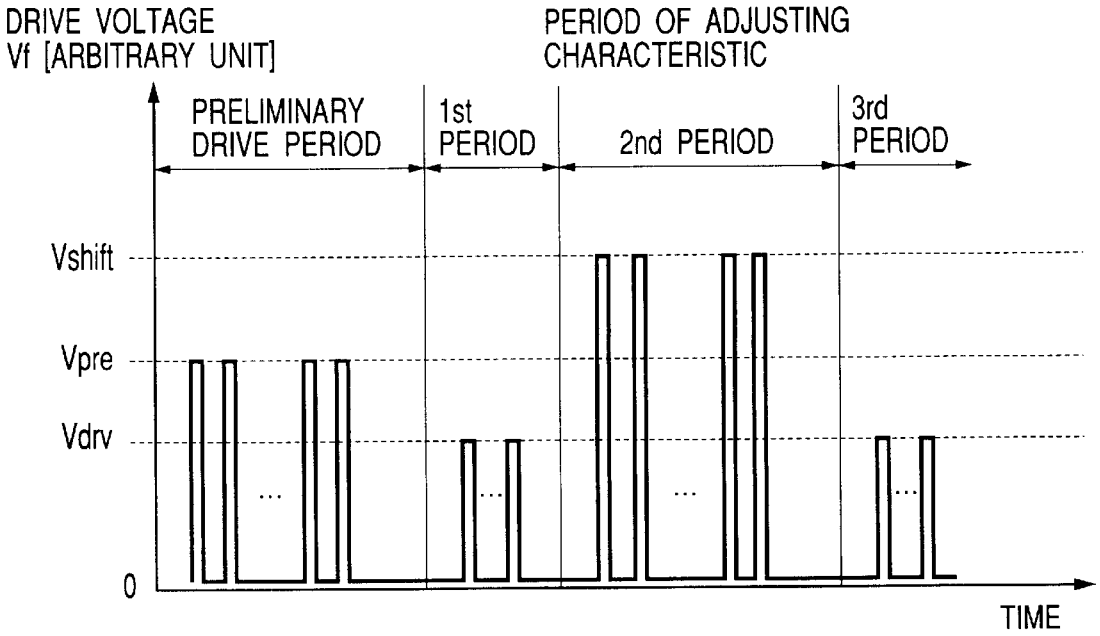
FIGS. 1A and 1B are diagrams showing examples of signals for adjusting the characteristics of SCE according to an embodiment of the invention.
Figure 1B:
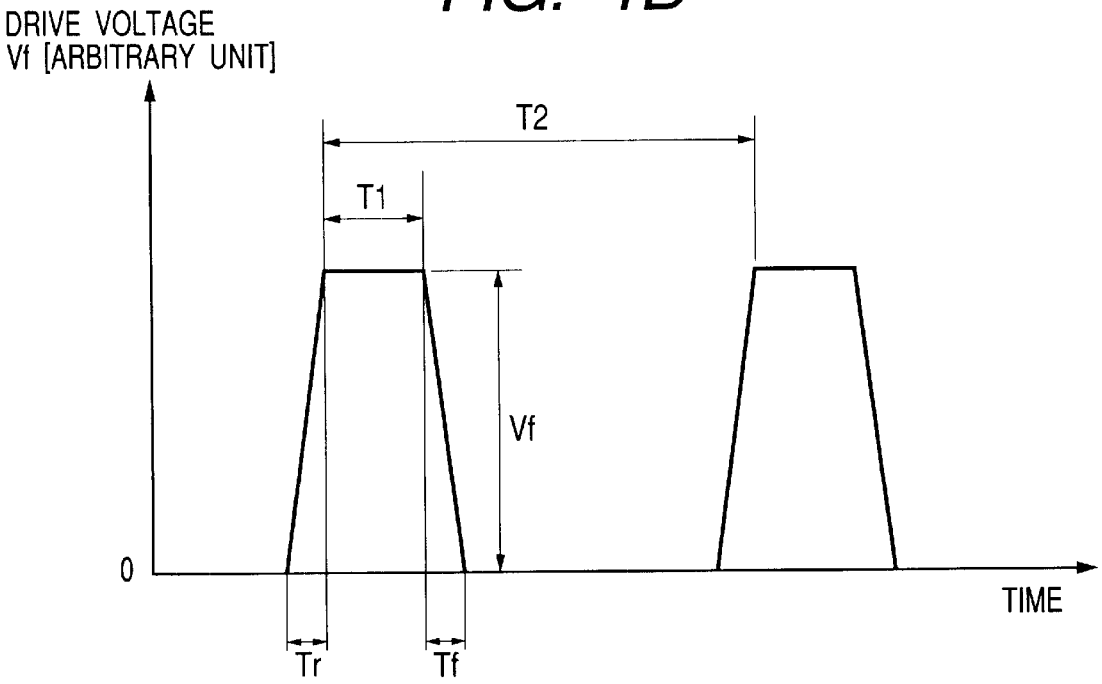

FIGS. 1A and 1B are diagrams showing examples of voltage waveforms of preliminary driving and characteristics adjustment driving signals applied to one device constituting a multi electron source. The abscissa represents a time and the ordinate represents a voltage (hereinafter called a device voltage Vf) applied to SCE.

The drive signal is consecutive rectangular voltage pulses such as shown in FIG. 1A. The application period of a voltage pulse during the characteristics adjustment drive period is divided into first to third three periods. During each period, one to thousand pulses are applied. The applied pulse peak value and the number of pulses change depending upon each device. A portion of the voltage pulse waveform shown in FIG. 1A is shown enlarged in FIG. 1B.

The specific drive conditions set were a drive signal pulse width T1 of 1 msec and a pulse period T2 of 10 msec. In order to set the rise time Tr and fall time Tf of an effective voltage pulse applied to each device to 100 ns or shorter, the impedance of a wiring line from a drive signal source to each device was sufficiently reduced to drive the device.

The device voltage Vf was set to Vf=Vpre during the preliminary drive period, and during the characteristics adjustment period, Vf=Vdrv during the first and third periods and Vf=Vshift during the second period. These device voltages Vpre, Vdrv and Vshift were larger than the device electron emission threshold voltage and satisfied the conditions of Vdrv<Vpr Vshift. Since the electron emission threshold voltage changes with the shape and material of SCE, the device drive voltages were set properly in accordance with SCE to be measured.

After all the devices are driven in the manner described above, the characteristics adjustment process for a multi electron source is completed.

Figure 2:
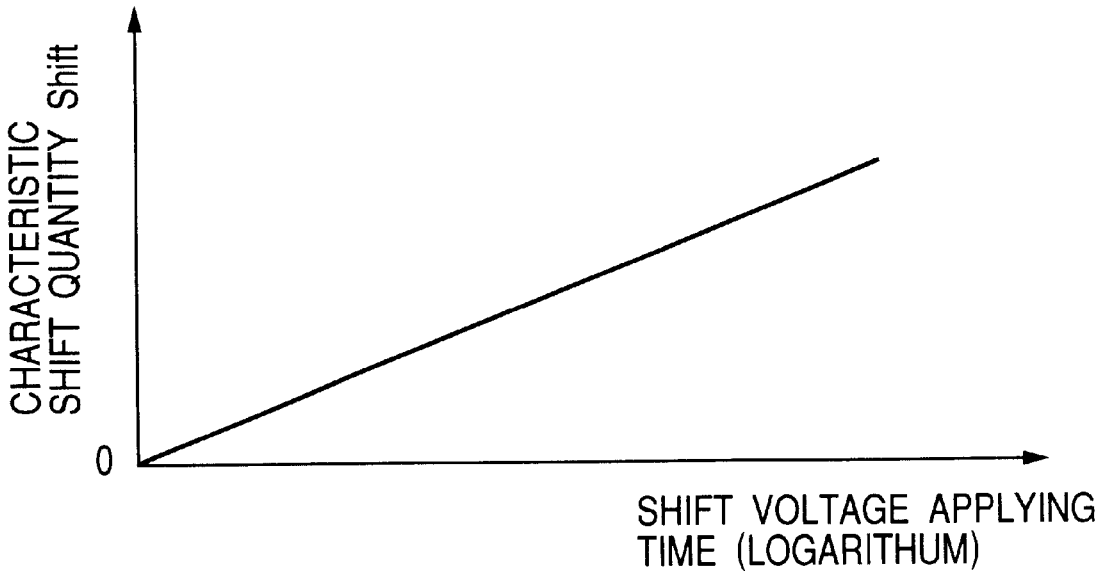
FIG. 2 is a graph showing the relation between a shift voltage applying time and a characteristics shift quantity.

There is a correlation between an application time of a shift voltage during the characteristics adjustment period and a shift amount of the characteristics. FIG. 2 is a graph schematically showing a correlation between an application time of a characteristics shift voltage Vshift and a characteristics shift amount Shift, the characteristics shift voltage being equal to or higher than the electron emission threshold voltage. The X-axis of the graph indicates the shift voltage application time in a logarithmic scale and the Y-axis indicates the characteristics shift amount Shift. As shown in FIG. 2, the characteristics shift amount increases generally in direct proportion to a logarithmic value of application time of the shift voltage.

Figure 3A:
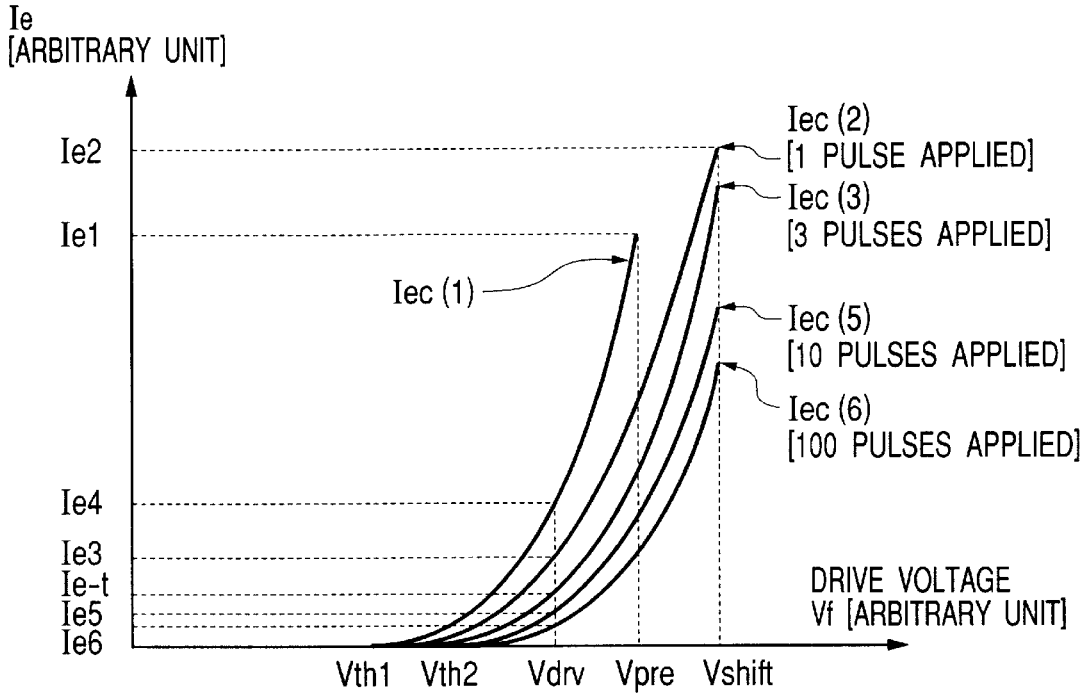
FIGS. 3A and 3B are graphs illustrating the emission current characteristics at different SCE drive voltages.

FIG. 3A is a graph showing another viewpoint of the graph of FIG. 2. As shown, as the number of applied pulses Vf=Vshift is increased, the emission current characteristics shifts to the right. A device having the characteristics of Iec (1) before shift pulse application changes the characteristics to Iec (2) after one Vshift pulse is applied. The emission current characteristics curve changes to Iec (3) after three Vshift pulses are applied, the emission current characteristics curve changes to Iec (5) after ten Vshift pulses are applied, and the emission current characteristics curve changes to Iec (6) after one hundred Vshift pulses are applied. The emission current Iec (5) on the emission current characteristics curve takes an emission current Ie5 at the normal drive voltage Vdrv, and the emission current Iec (6) takes the emission current Ie6 at the normal drive voltage Vdrv. By increasing or decreasing the number of Vshift pulses to be applied to a device during the second period, the emission currant characteristics curve can be changed as desired so that the electron emitting current at the normal drive voltage Vdrv during the third period can be set to a particular value.

Figure 3B:
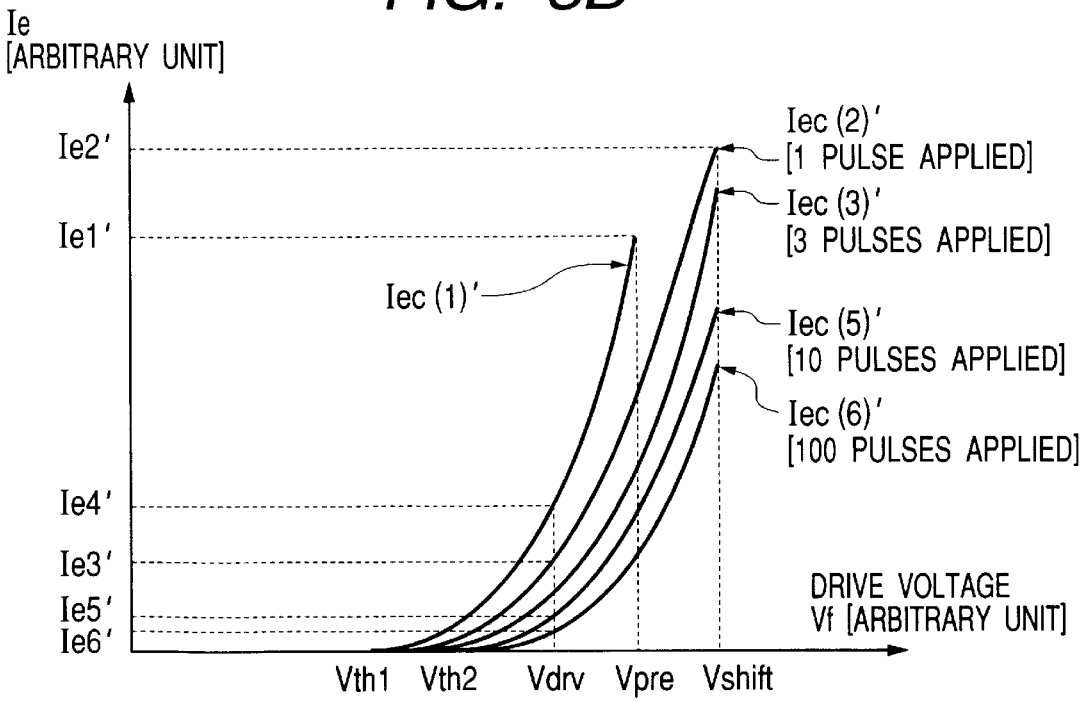

As seen from FIG. 3A, the electron emitting current of a device of a multi electron source is Ie4 when Vf=Vdrv is applied after the preliminary driving. This electron emitting current changes to Ie3→Ie5→Ie6 at the normal drive voltage Vf=Vdrv as the number of shift pulses Vf=Vshift is increased. A multi electron source is constituted of a number of devices each having different characteristics after the preliminary driving. The present applicant has vigorously studied how the electron emitting current changes when the characteristics shift voltage is applied to each device having different electron emission characteristics after the preliminary driving. The applicant has found that the characteristics change rate after application of characteristics shift voltage is generally constant independently from the electron emission amount before shift voltage application. Specifically, as shown in FIG. 3B, after the preliminary driving, the electron emitting current of a device having different initial characteristics from the device shown in FIG. 3A having Ie4' at Vf=Vdrv changed to Ie3'→Ie5'→Ie6' at Vf=Vdrv as the number of shift pulses Vf=Vshift was increased. Paying attention to the Ie change ratio shown in FIGS. 3A and 3B, Ie of the device (1) shown in FIG. 3A changes from Ie4 (start) to Ie3 (one pulse)→Ie5 (ten pulses)→Ie6 (one hundred pulses) as Vshift is applied, and the change ratio changes to Ie3/Ie4→Ie5/Ie4→Ie6/Ie4. Ie of the device (2) shown in FIG. 3B changes from Ie4' (start) to Ie3' (one pulse)→Ie5' (ten pulses) Ie6' (one hundred pulses) as Vshift is applied, and the change ratio changes to Ie3'/Ie4'→Ie5'/Ie4'→Ie6'/Ie4'. The present applicant has found that the change ratios of Ie3/Ie4 and Ie3'/Ie4', Ie5/Ie4 and Ie5'/Ie4', and Ie6/Ie4 and Ie6'/Ie4' are approximately equal. By utilizing this fact, the device characteristics can be adjusted by using a change curve of the same emission current characteristics even if the devices have the initial Ie currents somewhat different.

Of a number of devices, some devices have a very slow change rate after one Vshift voltage application and some devices have a very fast change rate after one Vshift voltage application as compared to the change rate on the change curve of the same emission current characteristics. Although the number of these devices is small, the applicant has found that the device characteristics of these devices can also be adjusted by using the change curve of the same emission current characteristics by applying pulses having widened or narrowed widths.

According to the invention, some devices of a multi electron source are used to acquire a change curve of the emission current characteristics after characteristics shift voltage application, and in accordance with the change curve, the characteristics of the whole multi electron source are adjusted. Although the details will be given later, the characteristics of the whole electron source can be adjusted by acquiring data through selection of applied shift voltage values at several discrete steps. The details will be given below.

Figure 4:
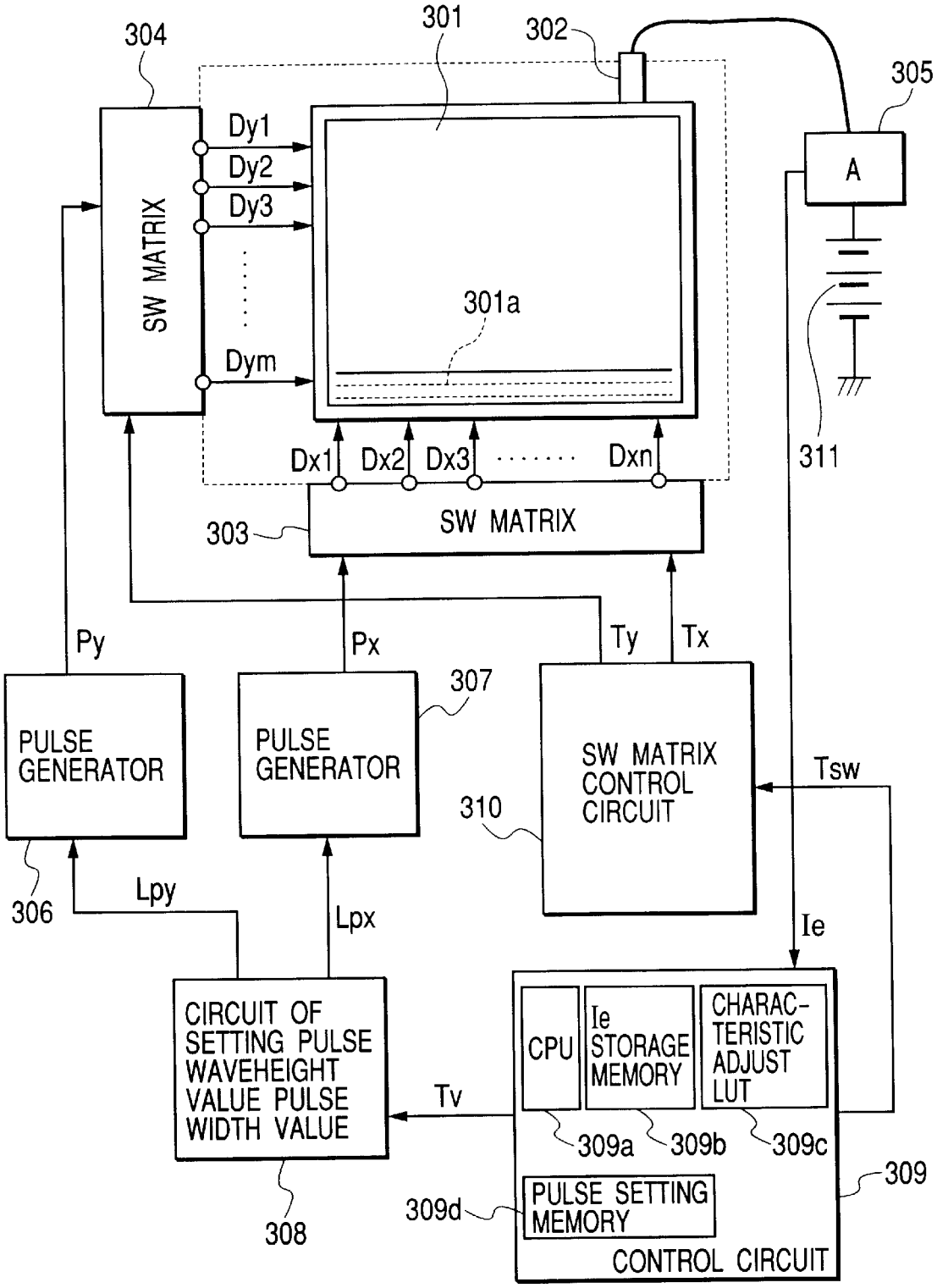
FIG. 4 is a schematic diagram showing the structure of an apparatus for applying a characteristics adjustment signal to a multi electron source according to an embodiment of the invention.

FIG. 4 is a block diagram showing the structure of a drive circuit for changing the electron emission characteristics of each SCE constituting a display panel using a multi electron source by applying a characteristics adjustment signal to each SCE. In FIG. 4, reference numeral 301 represents the display panel. In this embodiment, the display panel 301 has a plurality of SCEs passive matrix wired. It is assumed that SCEs were subjected to the energization forming and activation operations and are now under a stabilization operation.

The display panel 301 has a substrate having a plurality of SCEs disposed in a matrix shape and a face plate and the like having a phosphor for emitting light in response to electrons emitted from SCEs and disposed on the substrate spaced therefrom, respectively housed in a vacuum chamber. The display panel 301 is connected to external electronic circuits via row directional wirings Dx1 to Dxn and column directional wirings Dy1 to Dym. Reference symbol 301*a* represents a region of the substrate having SCEs disposed in a matrix shape in the display panel 301, this portion being provided with characteristics adjustment data acquisition devices.

Reference numeral 302 represents a terminal for applying a high voltage from a high voltage source 311 to the phosphor of the display panel 301. Reference numerals 303 and 304 represent switch matrixes for selecting SCE and applying a pulse voltage by selecting a row directional wiring and a column directional wiring. Reference numerals 306 and 307 represent pulse generators for generating pulse signals Px and Py. Reference numeral 308 represents a pulse peak (height) and width value setting circuit for outputting pulse setting signals Lpx and Lpy to set the peak value and width of each pulse signal to be output from the pulse generators 306 and 307. Reference numeral 309 represents a control circuit for controlling the whole characteristics adjustment flow and outputting data Tv to the pulse peak and width value setting circuit 308 to set the peak and width values. Reference symbol 309*a* represents a CPU which controls the operation of the control circuit 309. The operation of CPU 309*a* will be later described with reference to the flow charts of FIGS. 5, 6 and 11.

In FIG. 4, reference symbol 309*b* represents a pulse setting memory for storing the characteristics of each device to adjust the characteristics of the device. Specifically, the pulse setting memory 309*b* stores the electron emitting current Ie of each device when the normal drive voltage Vdrv is applied. Reference numeral 309*c* represents a reference look-up table created by acquiring data by applying a voltage to some devices, the look-up table being referred to when the characteristics are adjusted, and the details of the look-up table being later given. Reference symbol 309*d* represents a pulse setting memory for storing the peak and width of an application pulse suitable for each process. This memory is also used during characteristics adjustment when the pulse width is set again for an electron source having a considerably different change rate. Reference numeral 310 represents a switch matrix control circuit for outputting switching signals Tx and Ty and controlling a selection of switches of the switch matrixes 303 and 304 to select SCE to which a pulse voltage is applied.

Next, acquiring data necessary for the characteristics adjustment process will be described. In this embodiment, in order to adjust the electron emitting current of each device, the electron emission current Ie of each device is measured and stored. The details of measuring the electron emitting current Ie will be given. It is necessary for the characteristics adjustment to measure at least the electron emission currant Ie flowing when the normal drive voltage Vdrv is applied. This will be described. In response to a switch matrix control signal Tsw from the control circuit 309, the switch matrix control circuit 310 controls the switch matrixes 303 and 304 so that desired row and column directional wirings are selected and a desired SCE is driven.

The control circuit 309 outputs pulse peak and width value data Tv corresponding to the normal drive voltage Vdrv to the pulse peak and width value setting circuit 309. The pulse peak and width value setting circuit 308 outputs pulse peak value data Lpx and pulse width value data Lpy to the pulse generators 306 and 307, respectively. In accordance with the pulse peak and width value data Lpx and Lpy, the pulse generators 306 and 307 output drive pulses Px and Py which are selected by the switch matrixes 303 and 304 and applied to the device. The drive pulses Px and Py having a half amplitude of the normal drive voltage Vdrv (peak value) and opposite polarities is applied to the device. At the same time, a predetermined voltage is applied from the high voltage source 311 to the phosphor of the display panel 301.

According to the electron emission characteristics of SCE, as the device voltage equal to or higher than the threshold voltage is applied, the electron emitting current Ie increases abruptly, whereas the device voltage smaller then the threshold voltage is applied, the electron emission current Ie is hardly detected. Namely, SCE is a nonlinear device having a definite threshold voltage Vth relative to the electron emitting current Ie. Therefore, as the drive pulses Px and Py having an amplitude of a half Vdrv and opposite polarities are applied, electrons are emitted only from the device selected by the switch matrixes 303 and 304. The electron emitting current Ie of the device driven by the drive pulses Px and Py is measured with a current detector 305.

The process flow of adjusting the electron emission characteristics of each SCE constituting a multi electron source will be described with reference to the flow charts of FIGS. 5, 6 and 11. In this embodiment, the preliminary driving and characteristics adjustment driving are performed integrally. Both the drive processes will be described.

Figure 11:
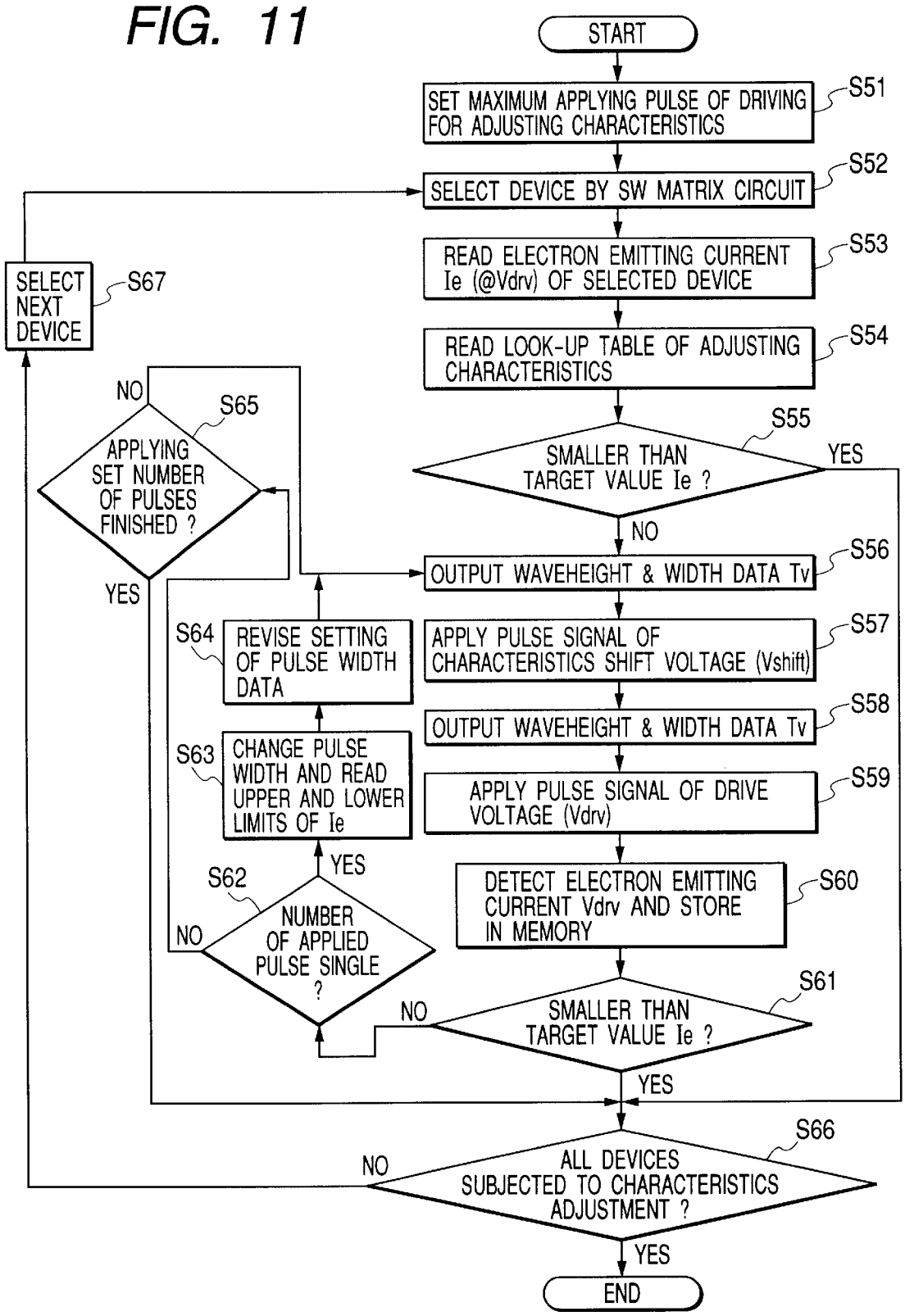
FIG. 11 is a flow chart illustrating the characteristics adjustment process following the flow chart shown in FIG. 6.

The process flow includes a first stage I (flow chart shown in FIG. 5, corresponding to the preliminary drive period and first period of the characteristics adjustment period shown in FIG. 1A), a second stage II (flow chart shown in FIG. 6, corresponding to the second and third periods of the characteristics adjustment period shown in FIG. 1A) and a third stage III (flow chart shown in FIG. 11, corresponding to the second and third periods of the characteristics adjustment period shown in FIG. 1A). At the first stage I, after the preliminary drive voltage Vpre is applied to all devices of the display panel 301, the electron emission characteristics when the normal drive voltage Vdrv is applied are measured to set a target standard electron emitting current Ie-t for the characteristics adjustment. At the second stage II, the look-up table is created by alternately applying the characteristics shift voltage Vshift and normal drive voltage Vdrv to each of some devices in the region 301*a* hardly obstructing an image display and by detecting an electron emitting current variation quantity. At the third stage III, the pulse waveform signal having the characteristics shift voltage Vshift is applied in accordance with the characteristics adjustment lookup table and the electron emission characteristics are measured at the normal drive voltage Cdrv in order to judge whether the characteristics adjustment is completed.

First, the first stage (flow chart of FIG. 5) will be described. At Step S11, in response to an output of the switch matrix control signal Tsw, the switch matrix control circuit 310 switches the switch matrixes 303 and 304 to select one device of the display panel 301. At Step S12 the pulse peak and width value data Tv of a pulse signal to be applied to the selected device and stored in advance in the pulse setting memory 309*d* is output to the pulse peak and width value setting circuit 308. The peak of a measurement pulse is the preliminary drive voltage Vpre=16 V and the pulse width is 1 msec. At Step S13 the pulse generators 306 and 307 apply a pulse voltage of the preliminary drive voltage Vpre to the device selected at Step S11 via the switch matrixes 303 and 304. At Step S14 in order to evaluate the electron emission characteristics of the device subjected to the preliminary drive and driven at the normal drive voltage Vdrv, the normal drive voltage Vdrv=14.5 V and pulse width of 1 msec preset in the pulse setting memory 309*d* are set as the pulse peak and width data Tv of a pulse signal to be applied to the selected device. At Step S15 a pulse signal of the normal drive voltage Vdrv is applied to the device selected at Step S11. At Step S16 the electron emitting current Ie at Vdrv is stored in the memory 309*b* for the characteristics adjustment.

It is checked at Step S17 whether the measurements are completed for all SCEs of the display panel 301. If not, the flow advances to Step S18 whereat the switch matrix control signal Tsw for selecting the next device is set to thereafter return to Step S11. If it is judged at Step S17 that the measurements are completed for all SCEs, then at Step S19 the electron emitting currents Ie of all SCEs of the display panel 301 at the normal drive voltage Vdrv are compared to set the target standard electron emitting current Ie-t.

The target standard electron emitting current Ie-t was set in the following manner.

As shown in FIG. 3A, upon application of the characteristics shift voltage, the Ie-Vf curve shifts to the right in any of the devices. Therefore, the target value is set to a small one among Ie's at Vdrv. However, if the target value is set too small, an average electron emission amount of a multi electron source after the characteristics adjustment lowers too much. In this embodiment, electron emitting current values of all devices were statistically processed to calculate an average electron emitting current Ie-ave and a standard deviation σ-Ie. The target standard electron emitting current Ie-t was set to Ie-t=Ie-ave−σ-Ie.

By setting the target standard electron emitting current Ie-t in the above manner, the electron emission amount of each device can be made level without greatly lowering the average electron emitting current of a multi electron source after the characteristics adjustment.

Next, the second stage II (flow chart of FIG. 6) will be described.

In creating the look-up table, characteristics shift voltage values at four discrete levels (Vshift1 to Vshift4) were selected and the characteristics shift amount at each voltage was measured. The range of the characteristics shift voltage is Vshift≧Vpre as described earlier, and properly set in accordance with the shape and material of SCE. The characteristics adjustment can be performed generally by dividing into several steps at an interval of about 1 V.

Figure 6:
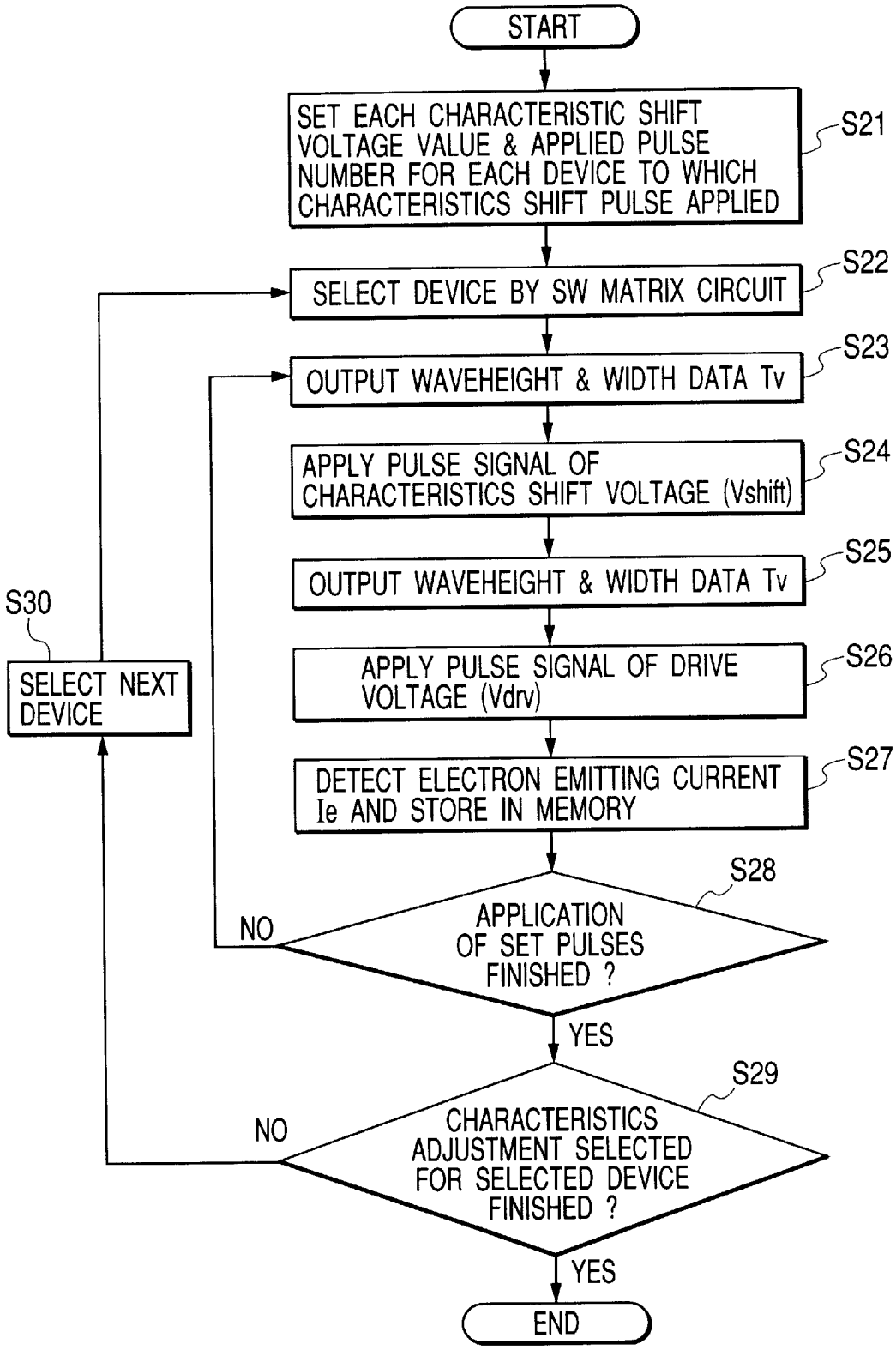
FIG. 6 is a flow chart illustrating the characteristics adjustment process following the flow chart shown in FIG. 5.

First, with reference to the flow chart shown in FIG. 6, description is made for a process of measuring a variation quantity of the device emission current Ie when the characteristics shift voltages of Vshift1, Vshift2, Vshift3 and Vshift4 (1 to 100 pulses) are applied to a plurality of devices.

At Step S21 the region of a plurality of SCEs to be applied with each of the characteristics shift voltages, the number of devices, each characteristics shift voltage value, a pulse width and the number of pulses are set. The region in the display panel 301 of a plurality of devices to be applied with each of the four characteristics shift voltages was set to the region 301*a* where an image display is hardly obstructed, and the number of devices was set to twenty devices per each characteristics shift voltage. At Step S22, the switch matrix control signal Tsw is output so that the switch matrix control circuit 310 switches the switch matrixes 303 and 304 to select one device of the display panel 301. At Step S23 the pulse peak and width value data Tv of a pulse signal to be applied to the selected device and preset in the pulse setting memory 309*d* is output to the pulse peak and width value setting circuit 308. The peak of the characteristics shift voltage is either the preliminary drive voltage Vpre=16 V, a characteristics shift voltage Vshift1=16.25 V, a characteristics shift voltage Vshift1=16.5 V, a characteristics shift voltage Vshift1=16.75 V, or a characteristics shift voltage Vshift1=17 V, and the pulse width is 1 msec for all cases. At Step S24, the pulse generators 306 and 307 apply the preliminary drive voltage Vpre as the first characteristics shift voltage to the device selected at Step S21 via the switch matrixes 303 and 304.

At Step S25 in order to evaluate the electron emission characteristics of the device subjected to the application of the characteristics shift voltage of the normal drive voltage Vdrv, the normal drive voltage Vdrv=14.5 V and pulse width of 1 msec preset in the pulse setting memory 309*d* are set as the pulse peak and width data Tv of a pulse signal to be applied to the selected device. At Step S26 a pulse signal of the normal drive voltage Vdrv is applied to the device selected at Step S22. At Step S27 the electron emitting current Ie at Vdrv is stored in the memory 309*b* as electron emission amount change data corresponding to the number of applied characteristics shift voltage pulses. It is checked at Step S28 whether the characteristics shift voltage is applied to the device selected at Step S22 a predetermined number of times. If not, the flow returns to Step S23.

If it is judged at Step S28 that the characteristics voltage is applied a predetermined number of times, the flow advances to Step S29 whereat it is checked whether the electron emission amount change measurements are completed for the predetermined number of devices. If not, the flow advances to Step S30 whereat the switch matrix control signal Tsw for selecting the next device is set to thereafter return to Step S22. If it is judged at Step S29 that the measurements are completed for the predetermined number of devices, then variation quantities of the electron emitting current when each of the five characteristics shift voltages Vshift0 (=Vpre), Vshift1, Vshift2, Vshift3 and Vshift4 is applied (1 to 100 pulses) to the predetermined number of devices, are plotted in a graph.

Figure 7:
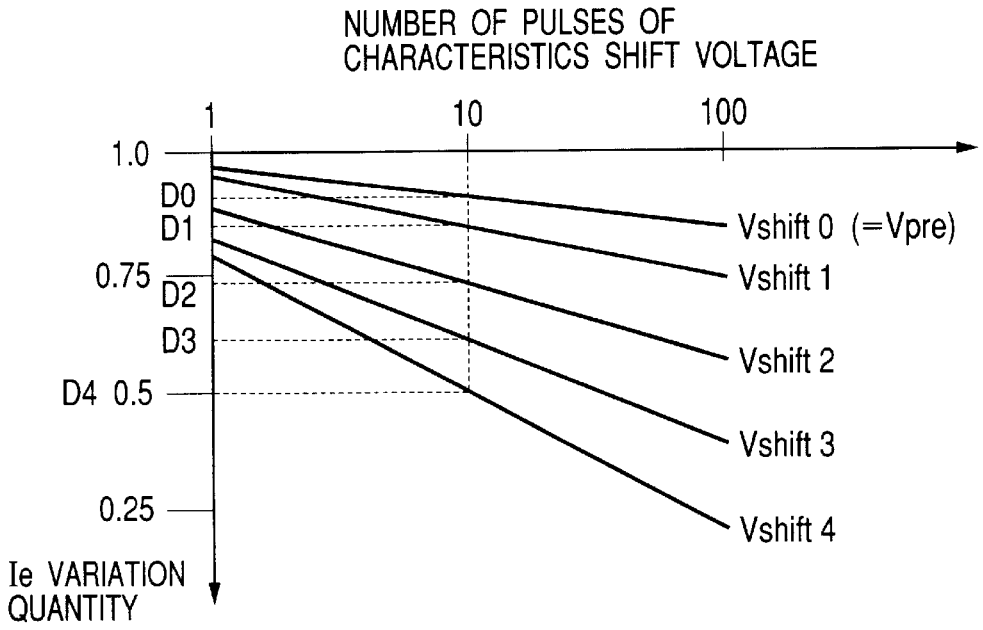
FIG. 7 is a graph showing characteristics curves illustrating a variation quantity of the electron emitting current when pulses are repetitively applied to the device at each of a plurality of drive voltages.

FIG. 7 is a graph showing the variation quantities (average values) of the electron emitting current when each of the five characteristics shift voltages Vshift0 (=Vpre), Vshift1, Vshift2, Vshift3 and Vshift4 is applied (0 to 100 pulses) to the predetermined number of devices. The device electron emitting current value is measured at the normal drive voltage (Vdrv) after each time one pulse of each characteristics shift voltage is applied. The relation between the five characteristics shift voltages is Vshift4>Vshift3>Vshift2>Vshift1>Vpre.

As shown in FIG. 7, as the number of characteristics shift voltage application times is increased or as the characteristics shift voltage is raised, the variation quantity of the device characteristics becomes large, i.e., the adjustment amount becomes large. The characteristics of a whole multi electron source are adjusted by the following two steps by using the characteristics change curves shown in FIG. 7.

Figure 5:
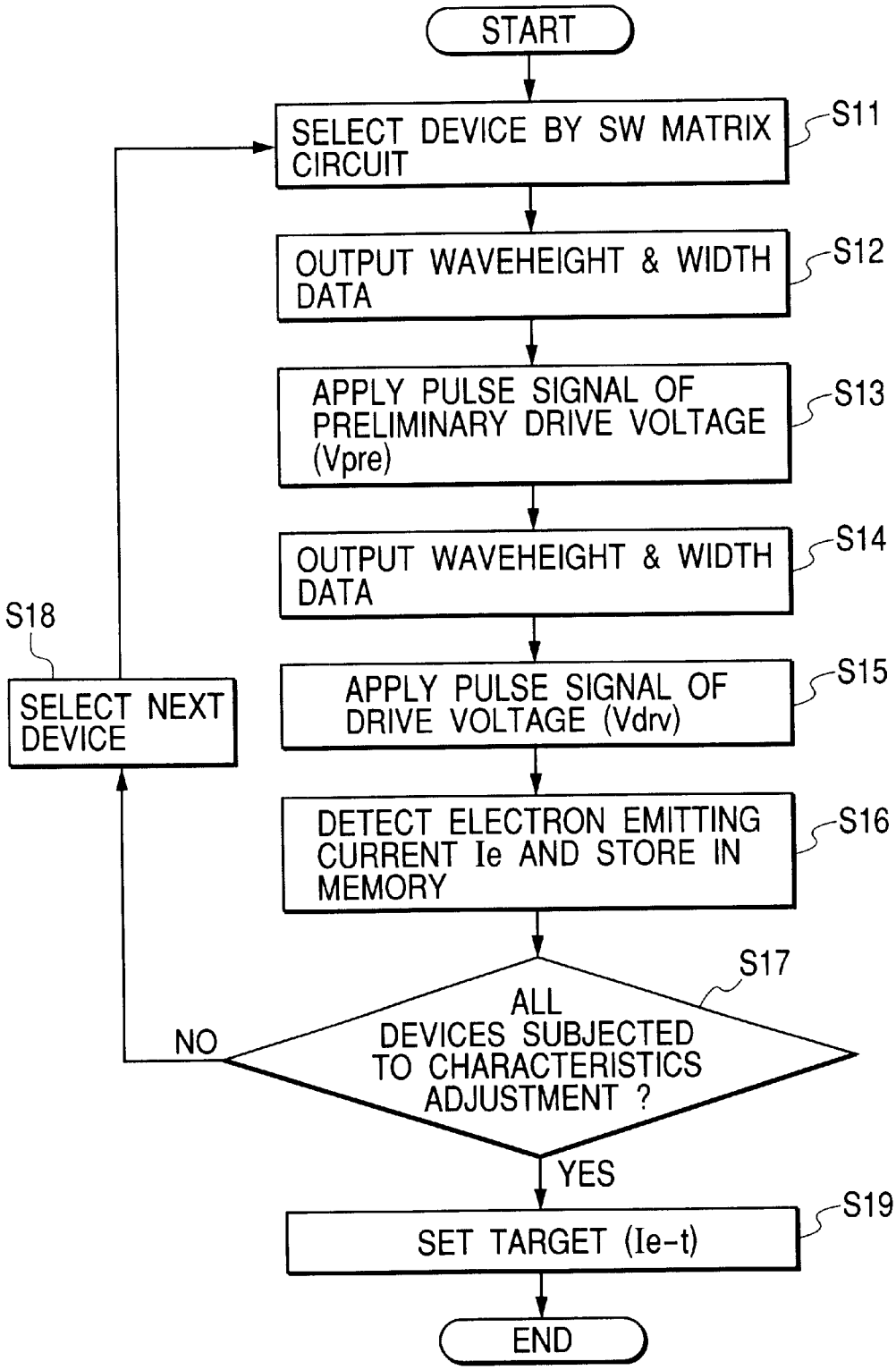
FIG. 5 is a flow chart illustrating a process of adjusting the characteristics of each SCE of an electron source by using the apparatus shown in FIG. 4.

(1) In accordance with the target standard emission current Ie-t set by the Ie measurement results obtained as illustrated in FIG. 5, a characteristics shift voltage range and an average number of applied pulses are set. Namely, this step creates the look-up table for the characteristics adjustment.

(2) In accordance with the values set at (1), the characteristics shift voltage for each device is set. By repeating the characteristics shift voltage application and electron emitting current characteristics measurement, the characteristics are shifted to the target value. This corresponds to the stage III (flow chart of FIG. 11, corresponding to the second and third periods of the characteristics adjustment period shown in FIG. 1A) whereat the pulse signal of the characteristics shift voltage Vshift is applied in accordance with the look-up table for the characteristics adjustments and the normal drive voltage Vdrv is applied to measure the electron emission characteristics in order to judge whether the characteristics adjustment is completed.

As described earlier, there are some electron sources, although not many, which have a considerably different change rate relative to the number of applied pulses illustrated in the characteristics change curves of FIG. 7. The characteristics of even such electron sources can be adjusted by incorporating a countermeasure to be described later into the characteristics adjustment steps (1) and (2) applicable to most of electron sources.

The details of the steps (1) and (2) will be given.

(1) The maximum adjustment rate Dmax is obtained by the following equation:

$$Dmax = Ie\text{-}t/Ie\ max$$

where Ie max is the maximum current value measured as illustrated in FIG. 5 and Ie-t is the target current Ie-t. For example, assuming that the target Ie-t=0.9 $\mu$A and Ie max=1.2 $\mu$A, it is necessary that Dmax=0.75. In this case, it can be seen from FIG. 7 that all devices cannot be adjusted if only one pulse of even the largest shift voltage Vshift4 is applied. As the number of characteristics shift voltage application pulses increases, it is not preferable because the characteristics adjustment process time prolongs. In this embodiment, therefore, the characteristics are adjusted with an average of ten pulses. The process time can be estimated from a product of a ten-pulse application time and the number of devices having the target Ie-t or larger.

Adjustment rates D0 to D4 of Ei when ten pulses are applied are read from FIG. 7.

An electron emitting current upper limit Ie-u of a device at the normal drive (Vdrv) immediately after an initial one pulse of the preliminary drive (Vpre) is applied which pulse is expected to obtain the target electron emitting current Ie-t immediately after 10 pulses of the characteristics shift voltage Vshift are applied, can be given by the following equation:

$$Ie\text{-}u = Ie\text{-}t/D$$

Namely, assuming that the adjustment rate when ten pulses of the characteristics shift voltage Vshift1 are applied is D1, an electron emitting current upper limit Ie-ul at the normal drive (Vdrv) after one pulse of the preliminary drive (Vpre) is applied is given by:

$$Ie\text{-u}\mathbf{1} = Ie\text{-}t/\text{D}\mathbf{1}$$

Similarly, assuming that the adjustment rate when ten pulses of the characteristics shift voltage Vshift2 are applied is D2, an electron emitting current upper limit Ie-u2 at the normal drive (Vdrv) after one pulse of the preliminary drive (Vpre) is applied is given by:

$$Ie\text{-u}\mathbf{2} = Ie\text{-}t/\text{D}\mathbf{2}$$

Assuming that the adjustment rate when ten pulses of the characteristics shift voltage Vshift3 are applied is D3, an electron emitting current upper limit Ie-u3 at the normal drive (Vdrv) after one pulse of the preliminary drive (Vpre) is applied is given by:

$$Ie\text{-u}\mathbf{3} = Ie\text{-}t/\text{D}\mathbf{3}$$

Assuming that the adjustment rate when ten pulses of the characteristics shift voltage Vshift4 are applied is D4, an electron emitting current upper limit Ie-u4 at the normal drive (Vdrv) after one pulse of the preliminary drive (Vpre) is applied is given by:

$$Ie\text{-u}\mathbf{4} = Ie\text{-}t/\text{D}\mathbf{4}$$

Assuming that the adjustment rate when ten pulses of the characteristics shift voltage Vshift0 are applied is D0, an electron emitting current upper limit Ie-u0 at the normal drive (Vdrv) after one pulse of the preliminary drive (Vpre) is applied is given by:

$$Ie\text{-u}\mathbf{0} = Ie\text{-}t/\text{D}\mathbf{0}$$

Figure 8:
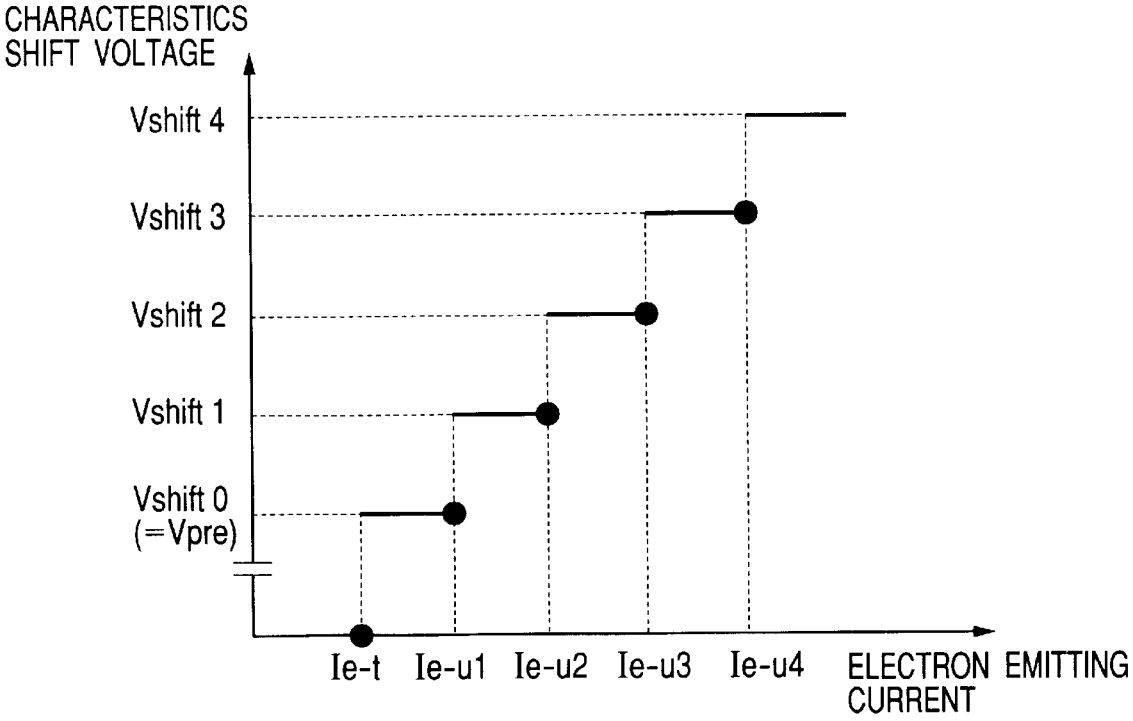
FIG. 8 is a graph showing the range of an electron emitting current of each SCE at each of discrete characteristics voltages applied for the characteristics adjustment of the apparatus shown in FIG. 4.

A look-up table for the characteristics adjustment created from these electron emission upper limits is shown in FIG. 8. As shown in FIG. 8, an electron emitting current range of a device at the normal drive (Vdrv) after one pulse of the preliminary drive (Vpre) is applied, for the characteristics adjustment upon application of the characteristics shift voltage Vpre (=Vshift0), is from the target Ie-t to Ie-u1. Similarly, an electron emitting current range of a device at the normal drive (Vdrv) after one pulse of the preliminary drive (Vpre) is applied, for the characteristics adjustment upon application of the characteristics shift voltage Vshift1, is from Ie-u1 to Ie-u2. An electron emitting current range of a device at the normal drive (Vdrv) after the preliminary drive (Vpre), for the characteristics adjustment upon application of the characteristics shift voltage Vshift2, is from Ie-u2 to Ie-u3. An electron emitting current range of a device at the normal drive (Vdrv) after the preliminary drive (Vpre), for the characteristics adjustment upon application of the characteristics shift voltage Vshift3, is from Ie-u3 to Ie-u4. An electron emitting current range of a device at the normal drive (Vdrv) after the preliminary drive (Vpre), for the characteristics adjustment upon application of the characteristics shift voltage Vshift4, is larger than Ie-u4. If the electron emitting current at the normal drive voltage Vdrv after the preliminary drive Vpre is larger than Ie-ue, Vshift4 was applied.

Assuming for example that the adjustment rates after ten pulses of each characteristics shift voltage are applied are D0=0.9, D1=0.81, D2=0.72, D3=0.6 and D4=0.5 and that the target Ie-t=0.9 μA and the maximum=1.55 μA, then Ie ranges of the device applied with respective characteristics shift voltages are 0.9<Ie≦1.0 μA (@Vshift0), 1.0<Ie≦1.11 μA (@Vshift1), 1.11<Ie≦1.25 μA (@Vshift2), 1.25<Ie≦1.5 μA (@Vshift3), and 1.5<Ie (@Vshift4).

Description is made for a method of dealing with an electron source having devices with a considerably different change rate relative to the number of applied pulses as illustrated in the characteristics change curves shown in FIG. 7. As described earlier, the electron emission characteristics of most of electron sources were able to be set to almost the target Ie-t at ten pulses or smaller per device, by creating the look-up table from the characteristics change curves shown in FIG. 7 assuming that the average number of applied pulses is ten pulses and by determining the characteristics shift voltage from this table. In the characteristics adjustment to be described later, the maximum number of pulses to be applied is set to twenty pulses which is twice the average number of applied pulses. Devices which were not able to have a value near the target Ie-t although the characteristics adjustment was performed include those devices unable to have the target Ie-t even if the maximum number of twenty pulses were applied and those devices which had a value much smaller than the target Ie-t during the characteristics adjustment. Namely, those devices are the devices with a considerably different change rate relative to the number of applied pulses as illustrated in the characteristics change curves shown in FIG. 7.

Description is made for a method of reducing the number of such devices or electron sources whose characteristics adjustment cannot be completed. First, in order to estimate whether there are such devices whose characteristics adjustment cannot be completed, an electron emitting current Ie measured by applying an initial characteristics shift voltage and thereafter applying the normal drive voltage Cdrv is compared with an electron emitting current Ie at the estimated change rate. The lower limit of the estimated change rate is the change rate D-l1 at which it cannot be expected that the device can have the target Ie-t even the maximum number of twenty pulses are applied. The upper limit of the estimated change rate is the change rate D-u1 at which it can be expected that the device has a value lower than the target Ie-t at the second pulse application. The characteristics change curves shown in FIG. 7 can be represented by a logarithmic scale. Therefore, for example, the characteristics change curve at the shift voltage Vshift0 and at the pulse width of 1 msec can be represented by:

$$y=A0\cdot logx+B0$$

where x is the number of pulses, y is the Ie variation quantity, A0 and B0 are constants.

The lower limit of the change rate D-l10 can be expressed in the following manner. If the change rate upon application of the initial characteristics shift voltage is the lower limit change rate D-l10, the characteristics change curve is given by:

$$y=A0\cdot log1+\text{D-l}10=\text{D-l}10$$

The change rate upon application of twenty pulses on this characteristics change curve is given by:

$$y=A0\cdot log20+\text{D-l}10$$

If this value is higher than the change rate upon application of ten pulses on the initially set characteristics curves, it cannot be expected that the characteristics adjustment has the target Ie-t upon application of the maximum number of twenty pulses, so that:

$$A0\cdot log20+\text{D-l}10<A0\cdot log10+B0$$

The lower limit change rate D-l10 can therefore be given by:

$$\text{D-l}10<A0\cdot log10+B0-A0\cdot log20$$

$$<B0-A0\cdot log2\cong B0-0.3\cdot A0$$

Figure 9:
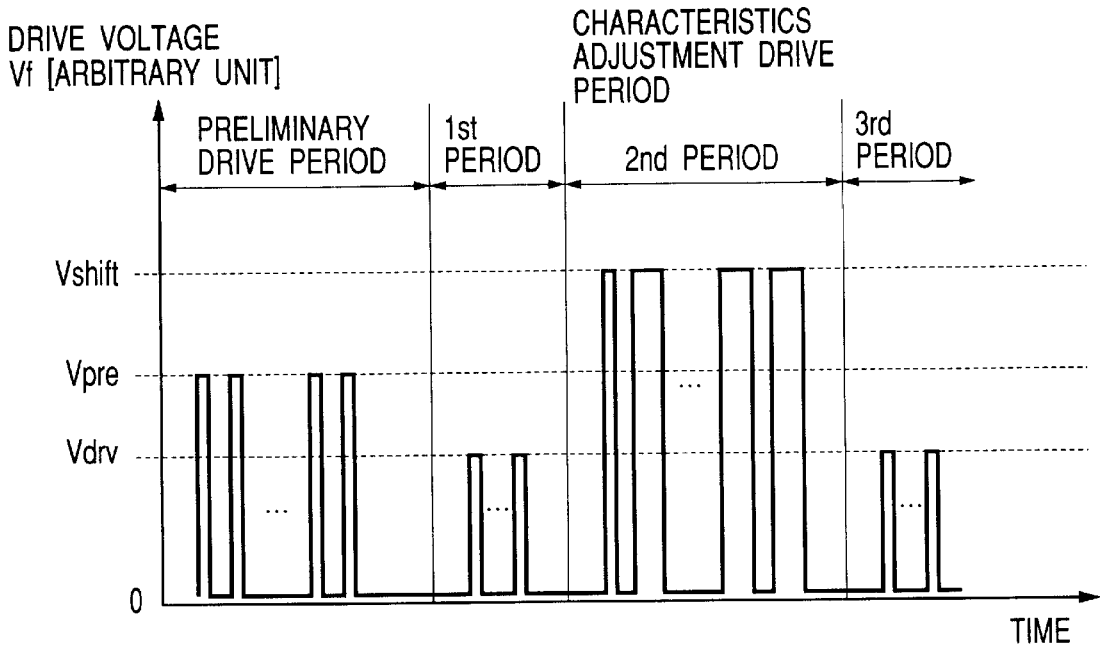
FIG. 9 is a diagram showing an example of a characteristics adjustment signal to be applied when it is judged that the adjustment target value cannot be obtained even if pulses of the initially determined number are applied to SCE of the apparatus shown in FIG. 4.

If the change rate upon application of the initial pulse voltage is smaller than the lower limit change rate D-l10, it can be expected that the target Ie-t can be obtained within the maximum number of twenty pulses. However, if the change rate is larger than the lower limit change rate Dl10, it cannot be expected that the target Ie-t can be obtained. If the change rate is larger than the lower limit change rate Dl10, as shown in the second period of the characteristics adjustment period of FIG. 9, the pulse width of the second and succeeding pulse signal is broadened. This means that the variation quantity at each pulse application is made large, so that the target Ie-t can be obtained before and after the average number of applied pulses. In this embodiment, the pulse width of the second and succeeding pulses was set to 2 msec which is a twofold of 1 msec.

The upper limit of the change rate D-u10 can be expressed in the following manner. If the change rate upon application of the initial characteristics shift voltage is the upper limit change rate D-u10, the characteristics change curve is given by:

$$y=A0\cdot log1+\text{D-u}10=\text{D-u}10$$

The change rate upon application of two pulses on this characteristics change curve is given by:

$$y=A0\cdot log2+\text{D-u}10$$

If this value is lower than the change rate upon application of ten pulses on the initially set characteristics curves, it cannot be anticipated that the characteristics adjustment has a value lower than the target Ie-t upon application of the second pulse, so that:

$$A0\cdot log2+\text{D-u}10>A0\cdot log10+B0$$

The upper limit change rate D-u10 can therefore be given by:

$$\text{D-u}10>A0\cdot log10+B0-A0\cdot log2>B0+A0\square log5\cong B0-0.7\cdot A0$$

Figure 10:
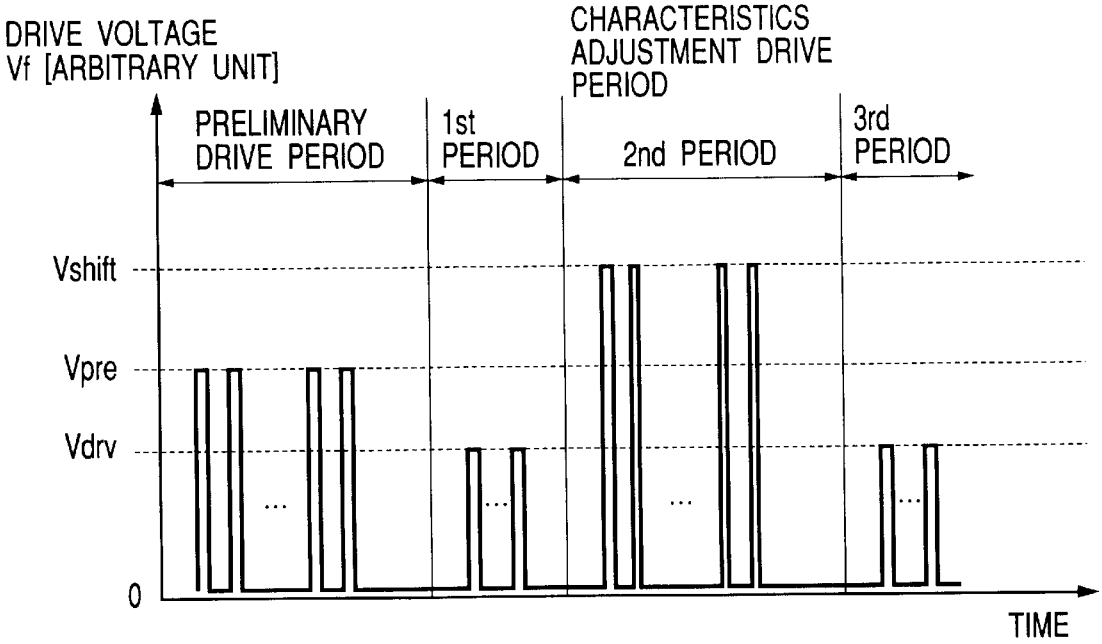
FIG. 10 is a diagram showing an example of a characteristics adjustment signal to be applied when it is judged that the current value exceeds the adjustment target value if pulses of the initially determined number are applied to SCE of the apparatus shown in FIG. 4.

If the change rate upon application of the initial pulse voltage is smaller than the upper limit change rate D-u10, as shown in the second period of the characteristics adjustment period of FIG. 10, the width of the second and succeeding pulses is narrowed. This means that the variation quantity at each pulse application is made large, so that the target Ie-t can be obtained before and after the average number of applied pulses. In this embodiment, the pulse width of the second and succeeding pulses was set to 0.1 msec which is one tenth of 1 msec.

Similarly, the lower change rates Dl11 to D-l14 and upper change rate D-u11 to D-u14 can be calculated for the characteristics shift voltage values Vshift1 to Vshift4, and the pulse width when the change rate becomes higher than the lower limit change rate and the pulse width when the change rate becomes lower than the upper change rate can be properly set. In order to process the device having a considerably different change rate relative to the number of applied pulses as illustrated in the characteristics change curves of FIG. 7, when the look-up table is created, the lower limit change rates D-l10 to D-l14 and upper change rates D-u10 to D-u14 at the shift voltages Vshift0 to Vshift4 are calculated, and the pulse width when the change rate becomes higher than the lower limit change rate and the pulse width when the change rate becomes lower than the upper change rate are properly set. These values are stored in the pulse setting memory 309*d*.

Next, the stage III (flow chart of FIG. 11) will be described.

First, at Step S51 the maximum number of pulses per each SCE of the display panel 301 is set which pulses are applied for the characteristics adjustment to SCE. The maximum number of pulses to be applied was set to twenty pulses which are a twofold of the average number of applied pulses. Next, at Step S52 the switch matrix control signal Tsw is output to the switch matrix control circuit 310 to switch the switch matrixes and select one SCE of the display panel 301. At Step S53, the electron emitting current of the selected device subjected to the preliminary driving and then applied with the normal drive voltage Vdrv is read. At Step S54 the characteristics adjustment look-up table is read. At Step S55 the electron emitting current of the selected device read at Step S53 is compared with the characteristics adjustment target Ie-t to thereby judge whether the characteristics adjustment is performed. If the electron emitting current of the selected device read at Step S53 is equal to or smaller than the characteristics adjustment target Ie-t, the characteristics adjustment is not performed and the flow advances to Step S66.

If the electron emitting current of the selected device read at Step S53 is larger than the characteristics adjustment target Ie-t, the pulse width and one of the characteristics shift voltages Vshift0 to Vshift4 corresponding to the electron emitting current of the device and selected by referring to the value of the look-up table read at Step S54 are set to the pulse setting memory 309*d*. At Step S56 the pulse peak and width data Tv of the pulse signal set to the pulse setting memory 309*d* and applied to the selected device is output to the pulse peak and width setting circuit 308. At Step S57, the pulse generators 306 and 307 apply the pulse signal of one of the characteristics shift voltages Vshift0 to Vshift4 to SCE selected at Step S52 via the switch matrixes 303 and 304. For example, assuming that the electron emitting current of SCE selected at Step S52 is Ie-p in the following range:

$$Ie\text{-u}2 < Ie\text{-}p \leqq Ie\text{-u}3$$

then the characteristics shift voltage is Vshift2 according to the characteristics adjustment look-up table shown in FIG. 8.

At Step S58 in order to evaluate the characteristics of the device subjected to the characteristics adjustment and driven at a lowered voltage of the normal drive voltage Vdrv, the normal drive voltage Vdrv and pulse width of 1 msec are set as the pulse peak and width data Tv of the pulse signal to be applied to the selected device and preset to the pulse setting memory 309*d*. At Step S59 a pulse signal of the normal drive voltage Vdrv is applied to the device selected at Step S52. The electron emitting current at this time is measured and stored in the memory at Step S60. At Step S61 it is checked whether the electron emitting current measured at Step S60 is not equal to or lower than the characteristics adjustment target Ie-t, the flow advances to Step S62 whereat it is checked whether the number of applied pulses is single. If the electron emitting current measured at Step S60 is equal to or lower than the characteristics adjustment target Ie-t, the characteristics adjustment is not performed to thereafter advance to Step S66.

At Step S62 it is checked whether the number of applied pulses is single. If single, the flow advances to Step S63. If it is the second or succeeding pulse, the flow advances to Step S65 whereat it is checked whether the cumulative number of applied pulses reaches the maximum number of pulses to be applied for the characteristics adjustment driving. At Step S63 the lower limit change rate and upper limit change rate corresponding to the characteristics shift voltage applied to the selected device are read from the pulse setting memory 309*d* in order to judge whether the selected device is a device having a considerably different change rate relative to the number of applied pulses as illustrated in the characteristics change curves shown in FIG. 7. The electron emitting current of the selected device subjected to the preliminary driving and then applied with the normal drive voltage Vdr, multiplied by the lower limit change rate is set as the lower Ie value, and multiplied by the upper limit change rate is set as the upper Ie value. These values are compared with the electron, emitting current measured at Step S60. At Step S64, if the electron emitting current measured at Step S60 is larger than the lower limit Ie value, the width of the pulse signal to be applied is revised to 2 msec which is a twofold of 1 msec, if it is smaller than the upper limit Ie value, the width of the pulse signal to be applied is revised to 0.1 msec which is one tenth of 1 msec, or if it is between the lower and upper limit Ie values, the width of the pulse signal to be applied is maintained at 1 msec to thereafter advance to Step S56 for the application of the second pulse.

At Step S65 it is checked whether the cumulative number of applied pulses to the selected device including the second and succeeding pulses reaches the maximum number of pulses to be applied for the characteristics adjustment driving. If not reach, the flow advances to Step S56 to apply a pulse similar to the previous pulse application, whereas if reaches, the flow advances to Step S66. At Step S66 it is checked whether all SCEs of the display panel were subjected to the characteristics adjustment. If not, the flow advances to Step S67 whereat the next device is selected, the switch matrix control signal Tsw is output, and thereafter returns to Step S52. If it is judged at Step S66 that all devices were subjected to the characteristics adjustment, then the flow is terminated. In this state, the electron emitting currents of all devices are leveled. The step (2) is therefore terminated. The process time is approximately a product of the number of devices having the initial Ie larger than the target Ie-t and the time taken to apply ten pulse shift voltages.

In addition to the method of dealing with the electron source having a considerably different change rate relative to the number of applied pulses as illustrated in the characteristics change curves of FIG. 7, another method may be used by which one of the characteristics shift voltage Vshift0 to Vshift4 applied to the electron source having a considerably different change rate is raised or lowered to apply it to the second and succeeding pulses to make the change rate have a value near to the estimated change rate and reach the target Ie-t.

In this embodiment, the characteristics adjustment look-up table is created for each display panel 301 and the characteristics adjustment is performed by using the characteristics adjustment look-up table. If the characteristics adjustment is performed for display panels of the same lot by using the same target electron emitting current Ie-t of SCE, the characteristics adjustment look-up table may be created only for the first display panel. In this case, for the second and succeeding display panels, if the measurement results of the electron emission characteristics at the normal drive voltage Vdrv after the preliminary drive voltage Vpre is applied to all SCEs of the display panel 301 fall in a range capable of setting the current value to the target electron emitting current Ie-t, then the characteristics adjustment is possible by using the characteristics adjustment look-up table for the first display panel, without obtaining data for all the characteristics change curves shown in FIG. 7 but obtaining only some confirmation data. In this manner, the process time for the characteristics adjustment of the second and succeeding display panes can be shortened.

In this embodiment, the electron emitting currents are measured and the characteristics adjustment is performed to level the electron emitting currents. Instead, the luminance of the phosphor which emits light upon reception of electrons from SCE may be measured and the characteristics adjustment is performed to level the luminance. Namely, the luminance of the phosphor which emits light upon reception of electron from a device when the device is driven, is measured with a CCD sensor or the like. The measured luminance is converted into a value corresponding to the electron emitting current to level the electron emitting currents.

In this embodiment, although the devices in the image display area 301*a* of the display panel is used, dummy devices not driven during an image display may be formed to acquire data from these dummy devices.

As described so far, according to the invention, for an electron generating apparatus having a multi electron source with a plurality of SCEs, a characteristics adjustment process time for each SCE can be leveled with simple structures. In mass production, variations of the electron emission characteristics of electron source panels after the characteristics adjustment and variations of characteristics adjustment times can be suppressed and the management of manufacture processes can be made easy.

What is claimed is:

1. A characteristics adjustment method for a multi electron source having a plurality of electron emitting devices disposed on a substrate, comprising steps of:

measuring electron emission characteristics of each of the electron emitting devices and setting a characteristics adjustment target value;

applying a plurality of characteristics shift voltages having discrete values to some of the electron emitting devices, measuring electron emission characteristics of these electron emitting devices, and creating a characteristics adjustment table for each of the characteristics shift voltage values in accordance with change rates of these measured electron emission characteristics of these electron emitting devices;

selecting a predetermined characteristics shift voltage value from the plurality of characteristics shift voltage values by referring to the characteristics adjustment table created for each of the electron emitting devices and applying the predetermined characteristics shift voltage to the electron emitting devices to shift the characteristics toward the characteristics adjustment target value; and monitoring a change in the electron emission characteristics to revise a characteristics shift condition.

2. A characteristics adjustment method for a multi electron source according to claim 1, wherein the characteristics adjustment table is created by measuring a change in emission current when different characteristics shift voltages are applied to some of the electron emitting devices of the multi electron source.

3. A characteristics adjustment method for a multi electron source according to claim 1, wherein the electron emission characteristics are related to an electron emitting current or an emission light luminance.

4. A characteristics adjustment method for a multi electron source according to claim 1, wherein the characteristics shift condition is revised by a step of judging whether the change rates of the electron emission characteristics after an initial characteristics shift pulse is applied fall in a predetermined range and a step of revising a pulse width of the characteristics shift voltage if the change rates do not fall in the predetermined range.

5. A characteristics adjustment method for a multi electron source according to claim 4, wherein the predetermined range is determined from upper and lower limit values of the change rates of the electron emission characteristics when a prescribed characteristics shift voltage is applied.

6. A characteristics adjustment apparatus for adjusting electron emission characteristics of each of a plurality of electron emitting devices disposed on a substrate of a multi electron source, comprising:

a selection control circuit for selecting the electron emitting devices constituting the multi electron source;

a pulse peak and width value setting circuit for setting pulse peak and width values of a voltage to be applied to each of the electron emitting devices;

a drive circuit for applying the voltage set by said pulse peak and width value setting circuit to the electron emitting devices selected by said selection control circuit;

a circuit for measuring an electron emitting current of the electron emitting device driven by said drive circuit;

a memory for storing a measured value of the electron emitting current;

a calculation circuit for creating a characteristics adjustment table in such a manner that said selection control circuit selects some of the electron emitting devices, said pulse peak and width value setting circuit sets a plurality of characteristics shift voltages having discrete values, said drive circuit drives some of the electron emitting devices, an average of change rates of the electron emission characteristics of some of the electron emitting devices is calculated in accordance with values measured by said measuring circuit when each characteristics shift voltage is applied, and in accordance with the calculated average, the characteristics adjustment table is created for adjusting electron emitting current characteristics of the electron emitting devices;

a memory for storing the characteristics adjustment table and the pulse peak and width values of the characteristics shift voltage to be applied to the electron emitting devices; and a control circuit for setting again the values set by said pulse peak and width value setting circuit in accordance with the characteristics adjustment table and the electron emitting current.

* * * * *

UNITED STATES PATENT AND TRADEMARK OFFICE

CERTIFICATE OF CORRECTION

PATENT NO. : 6,661,179 B2
DATED : December 9, 2003
INVENTOR(S) : Shuji Aoki et al.

It is certified that error appears in the above-identified patent and that said Letters Patent is hereby corrected as shown below:

Title page,
Item [56], References Cited, FOREIGN PATENT DOCUMENTS
"JP 06-342636 * 12/1994" should be deleted (duplicate).

Column 4,
Line 22, "currant" should read -- current --.

Column 6,
Line 14, "current" should read -- current --.

Column 9,
Line 2, "is applied" should read -- are applied --.

Column 11,
Line 42, "even the" should read -- even if the --; and
Line 43, "are applied" should read -- is applied --.

Column 12,
Lines 15 and 17, "D1l0" should read -- Dl10 --;
Line 61, "Dl11" should read -- Dl10 --.

Column 14,
Line 37, "reach" should read -- reached --; and
Line 39, "reaches" should read -- reached --.

UNITED STATES PATENT AND TRADEMARK OFFICE

CERTIFICATE OF CORRECTION

PATENT NO. : 6,661,179 B2
DATED : December 9, 2003
INVENTOR(S) : Shuji Aoki et al.

It is certified that error appears in the above-identified patent and that said Letters Patent is hereby corrected as shown below:

Column 15,
Line 14, "panes" should read -- panels --.

Signed and Sealed this

Second Day of August, 2005

JON W. DUDAS
*Director of the United States Patent and Trademark Office*